US009908148B2

(12) United States Patent
Torrione

(10) Patent No.: US 9,908,148 B2
(45) Date of Patent: Mar. 6, 2018

(54) SYSTEM AND METHOD FOR MEASURING FLUID FRONT POSITION ON SHALE SHAKERS

(71) Applicant: COVAR APPLIED TECHNOLOGIES, INC., McLean, VA (US)

(72) Inventor: Peter A. Torrione, Durham, NC (US)

(73) Assignee: CoVar Applied Technologies, Inc., McLean, VA (US)

( * ) Notice: Subject to any disclaimer, the term of this patent is extended or adjusted under 35 U.S.C. 154(b) by 0 days.

(21) Appl. No.: 15/252,319

(22) Filed: Aug. 31, 2016

(65) Prior Publication Data

US 2017/0056929 A1 Mar. 2, 2017

Related U.S. Application Data

(60) Provisional application No. 62/212,233, filed on Aug. 31, 2015.

(51) Int. Cl.

| | |
|---|---|
| ***E21B 21/08*** | (2006.01) |
| ***B07B 1/42*** | (2006.01) |
| ***E21B 21/06*** | (2006.01) |

(52) U.S. Cl.

CPC ..... *B07B 1/42* (2013.01); *E21B 21/065* (2013.01)

(58) Field of Classification Search

CPC ..... B07B 1/42; E21B 21/065; E21B 21/08; E21B 47/04; E21B 47/042; G07C 3/08; H04N 5/247

See application file for complete search history.

(56) References Cited

U.S. PATENT DOCUMENTS

| | | | | |
|---|---|---|---|---|
| 2006/0162962 | A1 | 7/2006 | Koederitz et al. | |
| 2006/0243643 | A1* | 11/2006 | Scott | B01D 33/0376 209/309 |
| 2007/0165225 | A1 | 7/2007 | Trainer | |
| 2008/0128334 | A1 | 6/2008 | Scott et al. | |
| 2010/0235002 | A1* | 9/2010 | Dufilho | B01D 33/0315 700/275 |
| 2011/0210083 | A1* | 9/2011 | Scott | B01D 33/0315 210/785 |
| 2011/0220410 | A1 | 9/2011 | Aldred et al. | |
| 2012/0242822 | A1 | 9/2012 | Rodney et al. | |
| 2013/0044335 | A1 | 2/2013 | Jeon | |
| 2014/0333754 | A1* | 11/2014 | Graves | E21B 44/00 348/85 |
| 2015/0013448 | A1 | 1/2015 | Smith | |

FOREIGN PATENT DOCUMENTS

| | | | |
|---|---|---|---|
| WO | 2016077521 | A1 | 5/2016 |

OTHER PUBLICATIONS

International Search Report & Written Opinion (PCT/US2016/049729), dated Nov. 18, 2016, (11 pages).

* cited by examiner

*Primary Examiner* — Mark J Beauchaine
(74) *Attorney, Agent, or Firm* — Gregory L. Porter; Andrews Kurth Kenyon LLP

(57) ABSTRACT

A system for monitoring the fluid front on a shaker table is disclosed. The system comprises a shaker table or shaker table screen configured to be adjusted based on information compiled by a processor and at least one camera configured to monitor said shaker table. The camera may be operably connected to a processor. The processor may be configured to perform detection and localization of the fluid front on the shaker table using machine vision techniques.

17 Claims, 4 Drawing Sheets

SYSTEM AND METHOD FOR MEASURING FLUID FRONT POSITION ON SHALE SHAKERS

CROSS REFERENCE TO RELATED APPLICATIONS

This application claims the benefit of U.S. Provisional Application Ser. No. 62/212,233 filed Aug. 31, 2015. Applicant incorporates by reference herein Application Ser. No. 62/212,233 in its entirety.

FIELD OF THE INVENTION

The invention relates to systems and methods that use computer vision for locating the fluid front on a shale shaker during drilling operations.

BACKGROUND AND SUMMARY

Modern drilling often involves scores of people and multiple inter-connecting activities. Obtaining real-time information about ongoing operations is of paramount importance for safe and/or efficient drilling. As a result, modern rigs often have thousands of sensors actively measuring numerous parameters related to operations, in addition to information about the down-hole drilling environment.

Despite the multitude of sensors on today's rigs, a significant portion of rig activities and sensing problems remain difficult to measure with classical instrumentation. Person-in-the-loop sensing is often utilized in place of automated sensing.

By applying automated, computer-based video interpretation, continuous, robust, and accurate assessment of many different phenomena may potentially be achieved without requiring a person-in-the-loop. Automated interpretation of video data is commonly known as computer vision. Recent advances in computer vision technologies have led to significantly improved performance across a wide range of video-based sensing tasks. Computer vision may be used in some cases to improve safety, reduce costs and/or improve efficiency.

As drilling fluid is pumped into the wellbore and back up, it typically carries with it solid material known as drilling cuttings. These cuttings are typically separated from the drilling fluid on an instrument known as a shale shaker or shaker table. As the bulk of the drilling fluid passes through the shale shaker screen, a discernable fluid front is formed. The fluid front is the border between the area of the shale shaker screen which is substantially covered with drilling fluid and the area of the shale shaker which is comparatively free of drilling fluid. The process of separating the cuttings from the fluid may be difficult to monitor using classical instrumentation due to the violent nature of the shaking process. However, the location and orientation of the fluid front on the shale shaker is an important parameter to the drilling process that may be difficult to measure accurately. Currently this is somewhat difficult to measure and requires man-power to monitor.

The configuration of the shale shaker may be optimized based on the location of the fluid front, the size and/or characteristics of drill cuttings, the characteristics of the shale shaker screen being used, and/or other parameters. Adjusting the angle of the shale shaker, relative to level, may help maximize the efficiency and lifespan of the shale shaker and shaker screens. If a shaker table is at too steep of a level, the portion of the screens closest to the deposit of drilling fluid may become damaged more quickly by drill cuttings while the further removed portions of the screen are never utilized. A steep shaker angle may also lead to inefficient separation of the cuttings and the drilling fluid, thus complicating the gathering of information relating to the drill cuttings. If the angle of the shaker is too low, drilling fluid may simply run off the end of the shaker table, leading to lost drilling fluid and potential environmental contamination. The vibration speed of the shaker table may similarly be optimized in order to maximize the efficiency and the useful lifespan of a shaker table and shaker table screens.

Therefore, there is a need for an automated computer vision based technique for estimating the location of the fluid front on the shale shaker. Information from this system can be used to provide real-time information about the well-bore to the drill team, enabling real-time optimization of the shale shaker angle, thereby saving mud, and increasing efficiency.

DETAILED DESCRIPTION

Figure 1:
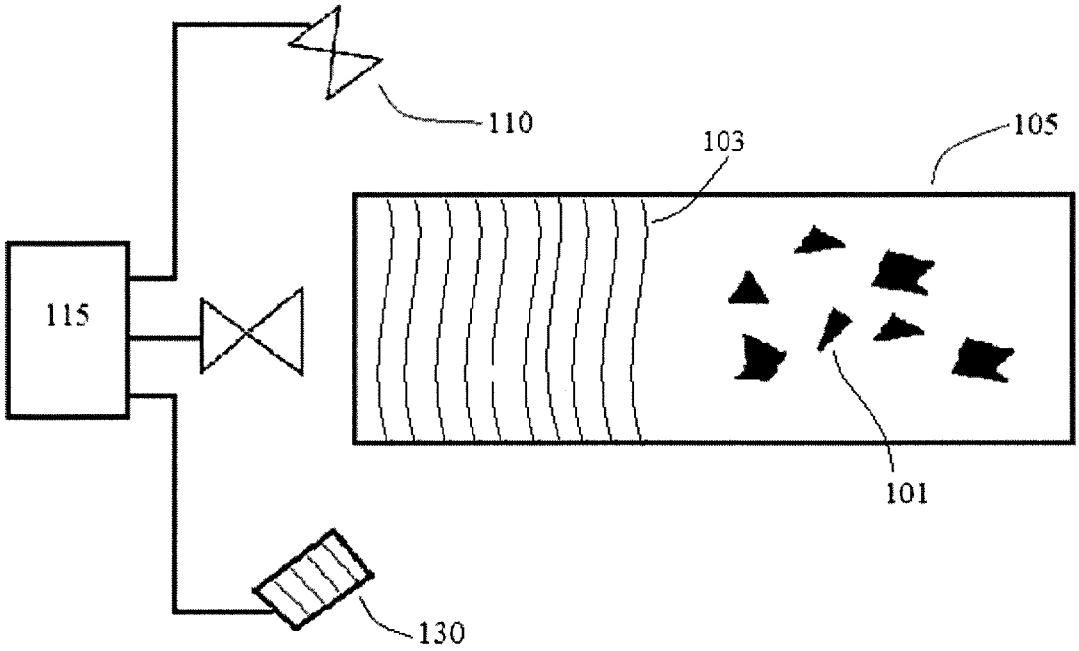
FIG. 1 depicts one potential embodiment of the disclosed system for locating a fluid front on a shale shaker comprising multiple cameras and distance sensing equipment.

The shale shaker fluid front video monitor ("SSFFVM") system may consist of a shaker table 105, at least one and preferably more than one camera 110 configured to include a view of the shaker table 105, and a processor 115 configured to visually identify the location of the fluid front 103 on the shaker table 105. In a preferred embodiment, two or more cameras 110 with known locations may be used in order to provide substantially stereo vision. Alternatively, RGB-D cameras, ranging cameras, and/or other distance sensing equipment 130, such as LIDAR, may be used. Depending on the speed of the shaker 105 and/or the rate at which the fluid front 103 is moving, the camera(s) 110 may collect frames at rates between 0.003 Hz (1 frame per 5 minutes) and 30 Hz. In some embodiments, the camera(s) 110 may collect frames at rates as low as 0.017 Hz (1 frame per minute), 0.03 Hz (1 frame per 30 seconds), or 0.1 Hz (1 framer per 10 seconds). In some embodiments, the camera(s) 110 may collect frames at rates as fast as 2 Hz, 5 Hz, 10 Hz, or 20 Hz.

Each camera 110 may contain, or may be connected to, a computer and/or processor 115 which may be configured to perform detection and localization of the fluid front 103 on the shaker 105. This may be performed by estimating the approximate location of the fluid front 103, the definition of the fluid front 103, and/or the contour (e.g., spatial extent and/or asymmetry) of the fluid front 103.

In some embodiments, information from the camera(s) 110 may be combined with information from other additional sensors. Information related to the flow-in, drilling pumps 230, flow-out, and/or pit volume, collectively known as the circulation system 200, may be useful in combination with some embodiments. By combining this information, the system may be able to provide different information and/or alerts under a wider variety of conditions, such as when the pumps 230 are on vs. off. Information across the different sensor modalities may be fused to allow the system to make better decisions under certain circumstances.

The cameras 110 and/or other sensors may be used to identify and localize the fluid front 103 on the shaker 105. The fluid front 103 is typically where the majority of the drilling fluid, commonly referred to as "mud" and/or cuttings slurry ends. This may be where the separated shale cuttings 101 begin and/or where the shaker screen 125 is exposed. The information related to the fluid front 103 may be tracked over time and logged to a database 150 for later retrieval and/or further analysis. This information may also be tracked over time and changes in location or behavior of the fluid may be brought to the mud-logger's or drill-team's attention using any suitable technique, such as a plain-text description of the observed change (e.g., "the fluid front appears to be too far forward on the shaker table"). The corresponding video data 410 may also be provided to the drill-team to allow for independent verification of the alert conditions. The fluid front information may also be used in a closed-loop control system to adjust various parameters, such as the angle or speed of the shaker table 105, if desired. Some embodiments of this system may allow the adjustments to be made automatically without human involvement.

Disclosed embodiments include many possible combinations of cameras 110 and sensors. For example, optical or video cameras, single or multi-stereo-cameras, IR, LIDAR, RGB-D cameras, or other recording and/or distance-sensing equipment 130 may all be used, either alone or in combination. Each camera 110 or combination of cameras 110 and sensors may also be used to track the location of the fluid front 103. Information from the cameras 110 and/or sensors can be combined with information from the circulation system 200 (e.g., flow-in, flow-out, and pit-volume) to modify the system's behavior as desired.

Cameras 110 (optical, IR, RGB-D, single, stereo, or multi-stereo among others) may be mounted within predefined constraints around the shaker table 105. In a preferred embodiment, camera orientations are approximately 45 degrees to the shaker table 105, but cameras 110 may be placed anywhere with a view of the fluid front 103. This may include from 0 degrees to 90 degrees to −90 degrees pitch and also includes 30, 40, 50, and 60 degrees pitch.

In some embodiments, multiple cameras 110 may be placed in mutually beneficial locations. As an example, stereo vision approaches may improve fluid front localization. Stereo cameras 110 typically view the same scene from approximately the same angle but from different spatial locations. Alternatively, cameras 110 viewing the same scene from different angles, such as a front and a side angle view, provide different views of the same objects and may reduce the need for assumptions, such as camera/screen geometry, and/or reduce the errors in the estimation of the fluid front location.

Cameras 110 may be equipped with a flash or other light source 120 to maintain substantially adequate illumination across multiple images. This may be useful since the ambient lighting can change significantly depending on the time of day or night and/or the weather conditions. By maintaining adequate, consistent, and/or constant lighting, some processing complications may be able to be avoided. In some disclosed embodiments, the brightness, intensity, color, and/or location of the light source 120 being used may be adjusted in response to the visual data 410 collected by the cameras 110 and/or other sensors.

The shale shaker or shaker table 105 may be any model, type, or design of shale shaker used in the industry. Additionally, custom designed shakers or shaker tables build for a specific application are also considered. One purpose of a shaker table is to separate drill cuttings from the drilling mud. Drilling mud is commonly used to cool and lubricate drilling components as well as transport the drill cuttings up to the surface from the bottom of the well bore. As is known in the industry, a wide variety of designs and components may be used to serve this purpose.

Disclosed embodiments allow the angle and speed of the shaker table 105 to be adjusted in response to information compiled by the processor 115. Traditionally, a human would be required to monitor the shale shaker periodically. There could be hours in between each individual observation performed by the human operator. The angle of some traditional shaker tables could be manually adjusted if the human operator determined that angle adjustment was necessary. Disclosed embodiments allow for observation of the shaker table 105 as often as every 5 minutes, 1 minute, 30 seconds, 10 seconds, 1 second, or substantially continuous monitoring. Disclosed embodiments also allow for adjustment of the angle and/or speed of the shale shaker 105 every 1 hour, 10 minutes, 5 minutes, 1 minute, 30 seconds, 10 seconds, 1 second, or substantially continuous adjustment of the shale shaker angle. This allows for maximizing the efficient use of the shaker table 105. This also prevents potentially devastating environmental impacts that can be caused when drilling fluid is allowed to run off the shaker table 105 due to inadequate adjustment of the angle and/or speed of the table 105 in response to changing conditions. Utilizing more frequent or nearly continuous monitoring and adjustment of shaker table angle and/or speed helps to prevent ecological damage and maintain the life of the shaker screens 125. Additionally, frequent monitoring and adjustment of the speed of the shaker table 105 may help to reclaim a higher percentage of the drilling fluid used in the well circulation system 200. By maintaining an ideal shaker speed, significant cost savings can be realized while minimizing the potential damage caused to the screen 125 by the drill cuttings 101. Disclosed embodiments may adjust the speed of the shaker table 105 through electronic, mechanical, or other appropriate controls of the motors responsible for vibrating the shale shaker. The angle of the shaker 105 may be adjusted using hydraulic, pneumatic, mechanical, or other known means for adjusting the angle of a shale shaker 105.

Shaker screens 125 are typically cleaned using pressurized water although a variety of known methods may be used. The screen 125 may be cleaned manually or, preferably, using an automated system. When the screen 125 is clean, disclosed embodiments will be most able to determine the overall damage of the shale shaker screen 125. Automated screen cleaning systems may involve at least one or a plurality of pressurized spray nozzles which spray water or another liquid at the screen 125 in order to clean it. Other automated screen cleaning systems may utilize brushes or pressurized air in order to clean the system. The nozzles used may be stationary or may be moved using an automated mounting system. If a plurality of nozzles is used, the automated system may be able to more adequately clean the entire screen without utilizing movable spray nozzles. If a single nozzle is used, it will likely need to be movable in order to adequately clean the entire surface of the screen. In some embodiments, only a portion of the screen will need to be cleaned in order to realize significant benefit from the automated screen cleaning system.

Different behaviors of the fluid front 103 and/or shaker 105 may be expected during active-flow periods when the mud pumps 230 are running and passive periods when the mud pumps 230 are off. Additional changes may manifest during the transient periods shortly after the pumps 230 switch either on or off. Additional data about the drilling process, such as hook load, bit depth, or rate of penetration, among others, may also be used to provide contextual information to the computer vision system in certain conditions.

In some embodiments, the fluid front 103 may be identified using a computer vision and machine learning system. For example, texture classification may potentially be used to identify the fluid front 103 since the visual "texture" of the mud as the shale shaker 105 is vibrating is typically different from the visual texture of the shaker table 105 and/or other nearby objects. The visual texture of the splashing, vibrating, and/or moving fluid behind the fluid front 103 stands in contrast to the relatively regular texture of the rest of the shaker 105. As a result, it may be possible to detect the fluid front 103 using texture features. These features may be used to distinguish an area from the shaker table 105 and/or background features, (e.g., since the distinguished area differs from the shaker 105 and/or background), and/or used in a multi-class classification framework (e.g., a 2-class support vector machine ("SVM")) to distinguish the "shaker" and/or "background" class from the "fluid" class.

Another example of computer vision that may be used to identify the fluid front 103 is change detection. The shale shaker 105 itself may provide a relatively static background. Even when the shaker 105 is moving, the information related to the pixels viewing the shaker 105 may remain stationary. In some embodiments, the information related to the pixels may include the statistical distribution of the pixel intensities in any color space (e.g., RGB). This may allow long-term background estimation (e.g., via Gaussian Mixture Models) to be used to estimate the background class when the pumps 230 are off and/or shortly after the pumps 230 turn on and before fluid appears on the shaker 105. This technique may also be used when the pumps 230 are on under certain conditions. These models may also be used to flag changes, which may be caused by the advent of the fluid front 103 on the shaker 105.

An additional example of computer vision that may be used to identify the fluid front 103 is reflectivity and/or color detection. The fluid front 103 is often a different color than the shale shaker 105 and may have different reflectance characteristics as well. Reflectance and/or color features may be used for fluid and/or shaker classification on their own, in combination with each other, and/or in combination with other disclosed techniques. Additionally, numerous other descriptor vectors may also be used in conjunction with and/or in addition to the techniques disclosed above. Other possible techniques include, but are not limited to, histogram of oriented gradients ("HOG"), scale invariant feature transform ("SIFT"), speeded-up-robust-features ("SURF"), binary robust independent elementary features ("BRIEF"), Viola-Jones, ("V-J"), Haar wavelet, and others.

Detection of the actual fluid front 103, as compared to the other fluid regions may be accomplished by classifying regions of the image as "fluid," "non-fluid," or any other classifier, and/or using image region properties on the resulting image regions to determine a potential class separating line. The fluid front 103 may be specified as a line, as a more complicated smoothly varying function (e.g., spline, quadratic, etc.), and/or as a combination of any of these. Preferably, the front 103 should be constrained to be on the shale shaker 105.

In some alternative embodiments, the image may be separated into fluid and/or non-fluid regions by hypothesizing numerous locations for the fluid front 103 and choosing at least one location corresponding to a location above a certain threshold likelihood separation between two distributions, one representing the fluid and one representing the shaker 105. Preferably, a chosen location corresponds to the maximum likelihood separation between the two distributions.

Still other optimization techniques may also be used to identify the location of the fluid front 103. For example purposes only, genetic algorithms, Markov-chain monte-carlo ("MCMC") techniques, additional background subtraction and/or correction techniques, among many other techniques may all be used.

Once detected, the fluid front location (line, quadratic, spline formulation, and/or any other demarcation) may be tracked over time. This may be accomplished through many different techniques. For example purposes only, tracking the fluid front 103 over time may be accomplished by appropriately parameterizing the fluid front representation and leveraging time-sensitive Kalman or Particle Filtering approaches to update the location of the fluid front 103 in a frame. Preferably this would be done in many frames, and most preferably in every frame. Alternatively, the fluid front location may be re-estimated in one, some, and/or all frames. This may also be done when the fluid front 103 was not previously detected.

In some embodiments, the fluid front location may be logged to a database 150 for later retrieval and further analysis. Changes in the location or behavior of the fluid may be brought to the mud-logger's or drill-team's attention with a plain-text description of the observed change (e.g., "the fluid front appears to be too far forward on the shaker table"), and the corresponding video data.

In other embodiments, the video data 410 and/or other data may also be tagged along with any information extracted during the computer vision processing process. Gathered information may be displayed to an operator with a user interface which may include an annotated image of the shaker tables 105 under consideration. This image may be automatically annotated and may also, in certain embodiments, display marks identifying a variety of key features, such as the fluid front 103, cuttings 101, any potential issues, etc.

Various control mechanisms may be appropriate to adjust and/or automate the angle and/or position of the shale shaker 105. For example, PID controllers, hydraulic pistons, electronic motors, and/or other systems may be used to adjust the shaker 105 based on acquired data.

The fluid front location estimation may also be used in a closed-loop control system to adjust various parameters (e.g., the angle) of the shaker table 105. This may enable automatic control of a shaker table system on a rig. This may result in saving time, saving money, and/or preventing undesirable ecological impacts.

FIG. 1 shows a potential embodiment of the system disclosed. This embodiment comprises two cameras 110 arranged to capture significantly different views of the fluid front 103 and drill cuttings 101 on the shaker table 105. This embodiment also utilizes distance sensing equipment 130. The cameras 110 and the distance sensing equipment 130 are connected to the processor 115 such that the captured data may be sent to the processor 115 and analyzed.

Figure 2:
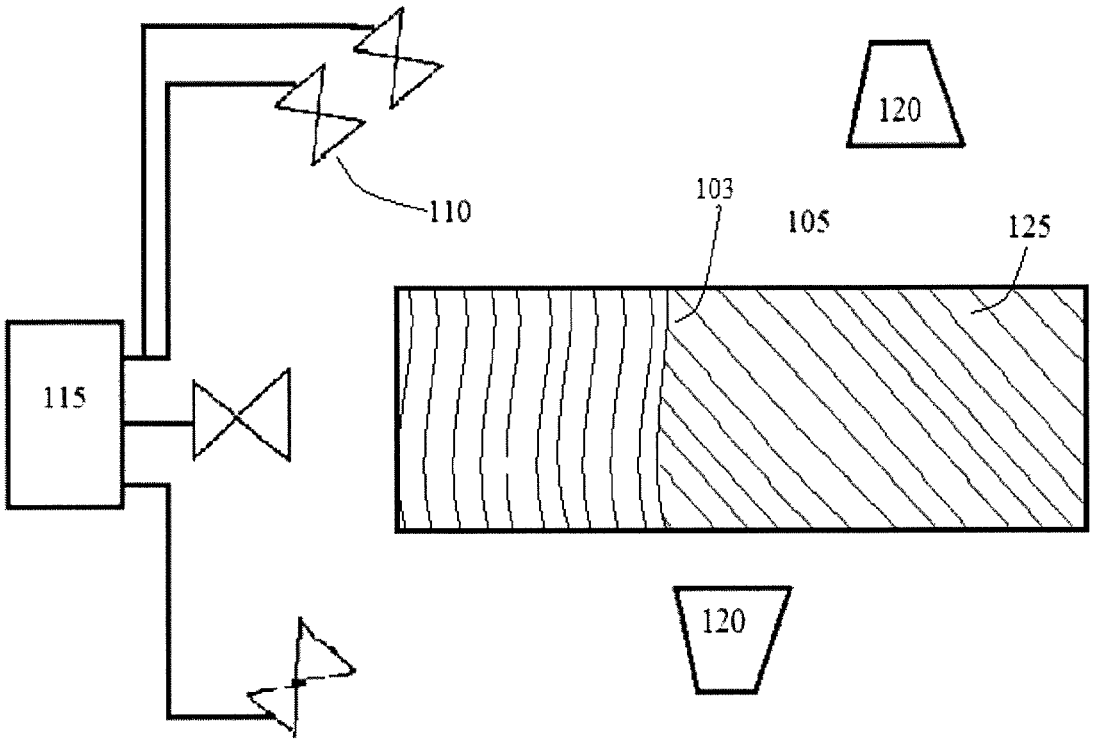
FIG. 2 depicts an embodiment of the disclosed system comprising multiple light sources and stereo vision cameras.

FIG. 2 shows a separate embodiment of the disclosed system. This figure highlights the shaker table screen 125 and fluid front 103. This figure also depicts the potential use of light sources 120 to illuminate the shaker table 105 during diverse times of day and weather. The different disclosed light sources 120 may be utilized either in combination or separately depending on the conditions. This figure also shows a possible stereo vision arrangement of cameras 110 which may be useful for obtaining additional visual data 410 for processing.

The specific position of the cameras 110, distant sensors 130, and the like in relation to the shaker table in FIGS. 1 and 2 may vary depending upon many factors such as number of shaker decks and the desired application. For example, in FIGS. 1 and 2 the cameras may be placed anywhere along the shaker table or even at the opposing end of the shaker table where the drier portion of the shaker is located in many instances. This may be particularly advantageous for multi-deck shakers.

Figure 3:
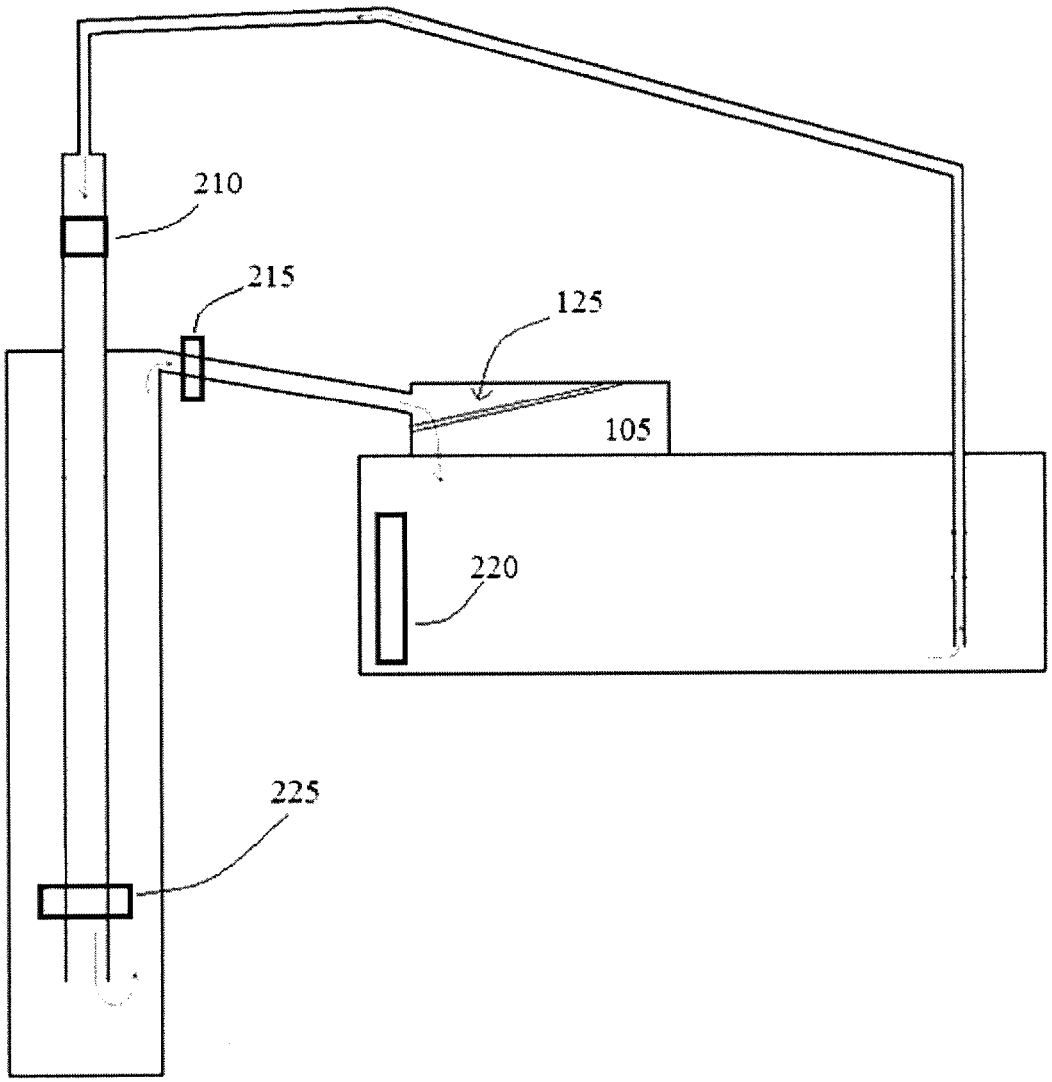
FIG. 3 depicts a typical well circulation system.

FIG. 3 shows a typical well circulation system 200 in which drilling fluid or mud may be pumped from a mud pit into a well bore. The mud is used to cool the drilling equipment as well as carry cuttings 101 up to the surface and deposit the cuttings on a shaker table 105. As the drilling fluid flows off of the shaker table 105, the fluid front 103 is formed. The fluid front location may vary depending on the angle and/or speed of the shaker table 105, the volume and rate of flow of the drilling fluid, and/or many other factors known in the art. The level of drilling mud in the pit may be detected using a pit volume sensor 220. The flow of mud entering the well bore may be detected using a well flow-in sensor 210. The flow of mud exiting the well may be detected using a well flow-out sensor 215. The depth of the drill bit may be detected using a bit depth sensor 225. The information gathered by these sensors and various combinations of this information may be integrated into the fluid front location analysis in order to provide a better understanding of the drilling operations and potential well conditions to an operator.

Figure 4:
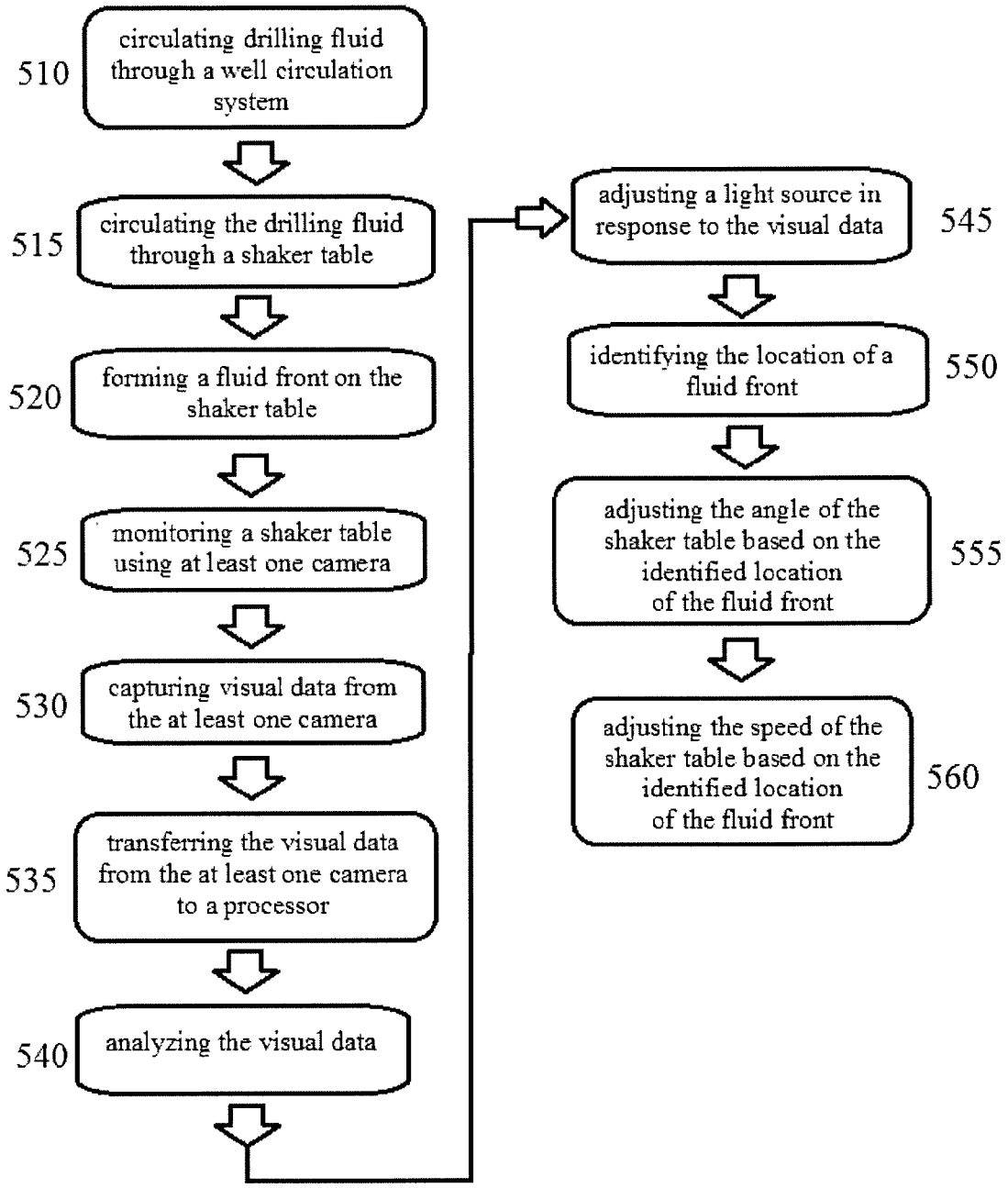
FIG. 4 depicts a potential method of locating a fluid front on a shaker table.

FIG. 4 outlines a potential method of locating a fluid front 103 and/or adjusting the shaker table 105 based on the location of the fluid front.

Disclosed embodiments relate to a system for monitoring a fluid front 103 on a shaker table 105, the system comprising a shaker table 105 and at least one camera 110 configured to monitor said shaker table 105, wherein the camera 110 is operably connected to a processor 115 and wherein said processor 115 is configured to identify a fluid front 103 on the shaker table 105. Additionally, the angle and/or speed of the shaker table 105 may be automatically adjusted based on information compiled by a processor 115, the processor 115 may be configured to perform detection and localization of the fluid front 103 on the shaker table 105. The system may further comprise distance sensing equipment 130 operably connected to the processor 115, at least one sensor for detecting a predetermined parameter of a well circulatory system 200, a well flow-in sensor 210, flow-out sensor 215, pit volume sensor 220, a light source 120 arranged and designed to provide adequate lighting during diverse weather conditions and times of day, at least two cameras 110 configured to provide stereo vision, at least two cameras 110 configured to monitor the shaker table 105 from significantly different angles, and/or a bit-depth sensor 225.

Disclosed embodiments may also relate to a system for monitoring a fluid front 103 on a shaker table 105, the system comprising a shaker table screen 125 and, at least one camera 110 configured to monitor said shaker table screen 125, wherein the camera 110 is operably connected to a processor 115, and wherein said processor 115 is configured to identify a fluid front 103 on the shaker table 105.

Other disclosed embodiments relate to a method for identifying the location of a fluid front 103 on a shaker table 105, the method consisting of the steps of circulating drilling fluid through a well circulation system 510, circulating the drilling fluid through a shaker table 515, forming a fluid front on the shaker table 520, monitoring a shaker table using at least one camera 525, capturing visual data from the at least one camera 530, transferring the visual data from the at least one camera to a processor 535, analyzing the visual data 540, adjusting a light source in response to the visual data 545, identifying the location of a fluid front 550, adjusting the angle of the shaker table based on the identified location of the fluid front 555, and/or adjusting the speed of the shaker table based on the identified location of the fluid front 560.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

What is claimed is:

1. A system for monitoring a fluid front on a shaker table, the system comprising:
- a shaker table;
- a processor; and
- at least one camera configured to monitor said shaker table, wherein the camera is operably connected to the processor, and wherein the processor is configured to identify a fluid front on the shaker table.

2. The system of claim 1, wherein the angle of the shaker table is automatically adjusted based on information compiled by the processor.

3. The system of claim 1, wherein the speed of the shaker table is automatically adjusted based on information compiled by the processor.

4. The system of claim 1, wherein the processor is configured to perform detection and localization of the fluid front on the shaker table.

5. The system of claim 1, further comprising distance sensing equipment operably connected to the processor.

6. The system of claim 1, further comprising at least one sensor for detecting a predetermined parameter of a well circulation system.

7. The system of claim 1, further comprising a well flow-in sensor, flow-out sensor, and pit volume sensor operably connected to the processor.

8. The system of claim 1, further comprising a light source arranged and designed to provide adequate lighting during diverse weather conditions and times of day.

9. The system of claim 1, further comprising at least two cameras configured to provide stereo vision.

10. The system of claim 1, further comprising at least two cameras configured to monitor the shaker table from significantly different angles.

11. The system of claim 1, further comprising a bit-depth sensor.

12. A system for monitoring a fluid front on a shaker table, the system comprising:
- a shaker table;
- a shaker table screen;
- a processor; and at least one camera configured to monitor said shaker table screen, wherein the camera is operably connected to the processor and wherein the processor is configured to identify a fluid front on the shaker table.

13. A method for identifying the location of a fluid front on a shaker table, the method consisting of:

monitoring a shaker table using at least one camera;

capturing visual data from the at least one camera;

transferring the visual data from the at least one camera to a processor;

analyzing the visual data using the processor; and identifying the location of a fluid front.

14. The method of claim 13, further comprising the step of circulating drilling fluid through a well circulation system; and circulating the drilling fluid through a shaker table.

15. The method of claim 13, further comprising the steps of automatically adjusting the angle of the shaker table based on the identified location of the fluid front.

16. The method of claim 13, further comprising the steps of automatically adjusting the speed of the shaker table based on the identified location of the fluid front.

17. The method of claim 13, further comprising the steps of adjusting a light source in response to analyzing the visual data.

* * * * *